United States Patent [19]

Taruno et al.

[11] Patent Number: 4,738,298

[45] Date of Patent: Apr. 19, 1988

[54] PROCESS FOR CASTING CYLINDER BLOCK BLANKS MADE OF LIGHT ALLOY

[75] Inventors: Yasunori Taruno, Hidaka; Takeshi Sakuma, Ooizumi; Yoshikazu Kanzawa; Masahiro Inoue, both of Tsurugashima; Masuo Ebisawa, Kawagoe; Shigeo Kaiho, Oomiya, all of Japan

[73] Assignee: Honda Giken Kogyo Kabushiki Kaisha, Tokyo, Japan

[21] Appl. No.: 883,800

[22] Filed: Jul. 7, 1986

[30] Foreign Application Priority Data

Jul. 4, 1985 [JP] Japan ..... 60-146997
Aug. 7, 1985 [JP] Japan ..... 60-173479

[51] Int. Cl.[4] ..... B22D 19/14; B22D 19/02

[52] U.S. Cl. ..... 164/97; 164/108; 164/112; 164/113; 164/305; 164/312; 164/103; 164/120

[58] Field of Search ..... 164/97, 98, 113, 312, 164/313, 108–110, 305, 103, 112, 120

[56] References Cited

U.S. PATENT DOCUMENTS 4,606,395 8/1986 Ban et al. ..... 164/97

FOREIGN PATENT DOCUMENTS 47263 4/1981 Japan ..... 164/305
71346 4/1983 Japan ..... 164/97
93558 6/1983 Japan ..... 164/98
66963 4/1984 Japan ..... 164/305
66964 4/1984 Japan ..... 164/98
97752 6/1984 Japan ..... 164/98
101271 6/1984 Japan ..... 164/97
136437 8/1984 Japan ..... 164/97
15061 1/1985 Japan ..... 164/97
8302782 8/1983 PCT Int'l Appl. ..... 164/98
2168631 6/1986 United Kingdom ..... 164/97

OTHER PUBLICATIONS

Metals Handbook, 8th Edition, vol. 5, p. 291, "Vents", 1970.

*Primary Examiner*—Nicholas P. Godici
*Assistant Examiner*—Samuel M. Heinrich
*Attorney, Agent, or Firm*—Armstrong, Nikaido, Marmelstein & Kubovcik

[57] ABSTRACT

A process for casting a cylinder block blank made of light alloy provided with a cylinder barrel reinforced around its cylinder bore with a reinforcing tubular body and a crankcase provided continuous to the cylinder bore, which includes placing the reinforcing tubular body in a first cavity formed for shaping a cylinder barrel at the lower portion of a mold which is formed at its upper portion with a second cavity for shaping a crankcase communicating with the first cavity, and pouring a light alloy molten metal from the lower portion of the first cavity into the first and second cavities while simultaneously venting gas from the first and second cavities.

10 Claims, 18 Drawing Sheets

PROCESS FOR CASTING CYLINDER BLOCK BLANKS MADE OF LIGHT ALLOY

BACKGROUND OF THE INVENTION

1. Field of the Invention

The present invention relates to a process for casting a cylinder block blank made of a light alloy, and more particularly, to a process for casting a cylinder block blank comprising a cylinder barrel having a reinforcing tubular body around each cylinder bore and a crankcase integral with the cylinder barrel.

2. DESCRIPTION OF THE PRIOR ART

In casting such cylinder block blanks, it is a conventional practice to use a mold having a crankcase shaping cavity at its lower portion and a cylinder barrel shaping cavity at its upper portion, the cylinder barrel shaping cavity being provided with a cast iron cylinder sleeve or a cylindrical shaped fiber article as a reinforcing tubular body, and to pour a molten metal from the bottom of the crankcase shaping cavity.

However, the practice and use of the mold as described above is accompanied by problems since the temperature of the molten metal is reduced by the time the molten metal is delivered to the cylinder barrel shaping cavity which causes poor adhesion between the reinforcing sleeve and the cast alloy or prevents the molten metal from completely filling or penetrating voids in the cylindrical shaped fiber reinforcing article.

SUMMARY OF THE INVENTION

It is an object of the present invention to provide the aforementioned casting process which will provide cylinder block blanks having improved adhesion between a cast iron cylinder reinforcing sleeve and the cast light metal alloy.

It is another object of the present invention to provide the aforementioned casting process in which a cylindrical or tubular shaped fiber reinforcing article will be more completely filled or penetrated with the molten metal.

To accomplish the above objects, according to the present invention, there is provided a process for casting a cylinder block blank made of a light alloy and having a cylinder barrel reinforced around its cylinder bore with a reinforcing tubular body and a crankcase integral with said cylinder barrel, which process comprises the steps of placing said reinforcing tubular body in a first cavity for shaping a cylinder barrel in a mold which is formed at its lower portion with said first cavity and at its upper portion with a second cavity for shaping a crankcase, said second cavity being in fluid communication with said first cavity; and pouring a light alloy molten metal from the lower portion of said first cavity into said first and second cavities.

Further, according to the present invention, there is provided a process for casting a cylinder block blank made of light alloy and including a cylinder barrel with a cast iron cylinder sleeve as a reinforcing tubular body, an outer wall portion surrounding said cylinder barrel, a water jacket located between said cylinder barrel and said outer wall portion and a crankcase provided integral with said cylinder barrel, comprising the steps of: mounting said cylinder sleeve and a sand core for said water jacket in a first cavity of a mold having said first cavity for molding the cylinder barrel and the outer wall portion disposed at its lower portion and a second cavity for molding the crankcase communicating with said first cavity disposed at its upper portion; and pouring a light alloy molten metal into said first and second cavities from the lower portion of said first cavity.

In addition, according to the present invention, there is provided a process for casting a cylinder block blank made of a light alloy and including a cylinder barrel reinforced around its cylinder bore with a cylindrical shaped fiber article as a reinforcing tubular body and a crankcase provided integral with said cylinder barrel, comprising the steps of: mounting said shaped fiber article on the outer peripheral surface of a cylinder bore shaping core of a mold which is provided at its lower portion with a first cavity for shaping a cylinder barrel surrounding said cylinder bore shaping core disposed with its axis turned in the vertical direction and said mold is provided at its upper portion with a second cavity for shaping a crankcase, said second cavity communicating with said first cavity; pouring a molten metal from the lower portion of said first cavity into said first and second cavities while venting a gas within said first and second cavities through a gas vent passage having a very small opening communicating with said second cavity; closing said gas vent passage, and completely solidifying the molten metal under a higher pressure.

Further, according to the present invention, there is provided a process for casting a cylinder block blank made of light alloy and including a cylinder barrel shaped fiber article as a reinforcing tubular body wherein the cylindrical shaped fiber article is mounted in the first cavity after being preheated to 300° or more.

With the above processes, the reinforcing tubular body is disposed in the cylinder barrel shaping first cavity disposed in a lower portion of the mold and the molten metal is poured into the first cavity from the lower portion thereof, and hence, the temperature of the molten metal contacting the reinforcing tubular body in the first cavity of the present invention is not reduced to the same degree as in conventional practice where the molten metal contacts the reinforcing tubular body in the upper or second cavity of a mold. Forming the cylinder barrel with the molten metal at a higher temperature enhances the adhesion between the cast light alloy and a cylindrical sleeve used as the reinforcing tubular body and, when a cylindrical shaped fiber article is used as a reinforcing tubular body, the molten metal will completely penetrate and fill the fiber article.

It is also noted in this process that when a sand core is disposed in the first cavity to provide a water jacket, it is possible to even more effectively prevent the undesirable reduction in the molten metal temperature due to the heat insulating action of the sand core.

Furthermore, the molten metal is poured or delivered to the first cavity from the bottom of the mold, which at the same time, the gas within the cavity is vented through a very small opening in the gas vent passage. Therefore, a back pressure may be developed by the effect of throttling the very small opening and may act on the entire surface of the molten metal. As a result, the tendency of the surface of the molten metal to form waves is suppressed and the surface of the molten metal rises substantially uniformly, whereby the gas can is prevented from being included into the molten metal and is vented with a good efficiency.

Thereafter, the molten metal is completely solidified under a higher pressure and hence, the high temperature molten metal is certain to penetrate and completely fill the shaped fiber article and the metal structure of the matrix can also be densified to improve the strength.

Accordingly, the use of the above-described process makes it possible to cast a higher quality and strength fiber-reinforced cylinder block blank which is free from the generation of any gas inclusions or unfilled voids.

In the above process, preheating the shaped fiber article to 300° C. or so enables the temperature of the molten metal to be maintained around the shaped fiber article, thereby avoiding the possibility that the heat of the molten metal may be absorbed by and solidify the shaped fiber article.

The above and other objects, features and advantages of the invention will be become apparent from reading the following detailed description taken in conjunction with the accompanying drawings.

BRIEF DESCRIPTION OF THE DRAWINGS

FIG. 6 being a front view in vertical section of the apparatus when a mold is opened, FIG. 7 being a front view in vertical section view taken along the line VIII—VIII in FIG. 7, and FIG. 9 being a sectional view taken along the line IX—IX in FIG. 8;

DESCRIPTION OF THE PREFERRED EMBODIMENTS

Figure 1:
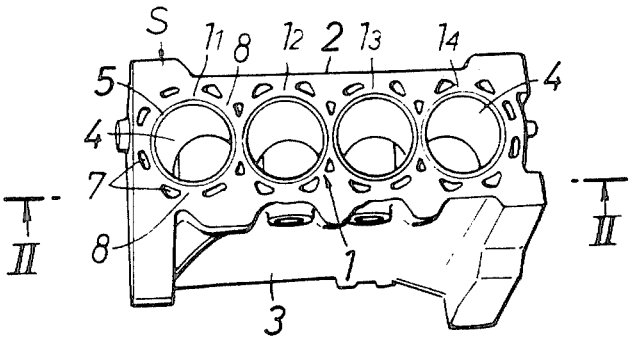
FIGS. 1 to 4 illustrate one example of a siamese-type cylinder block, FIG. 1 being a perspective view thereof as viewed from the above, FIG. 2 being a sectional view taken along the line II—II in FIG. 1, FIG. 3 being a sectional view taken along the line III—III in FIG. 2, and FIG. 4 being a perspective view as viewed from below.
Figure 2:
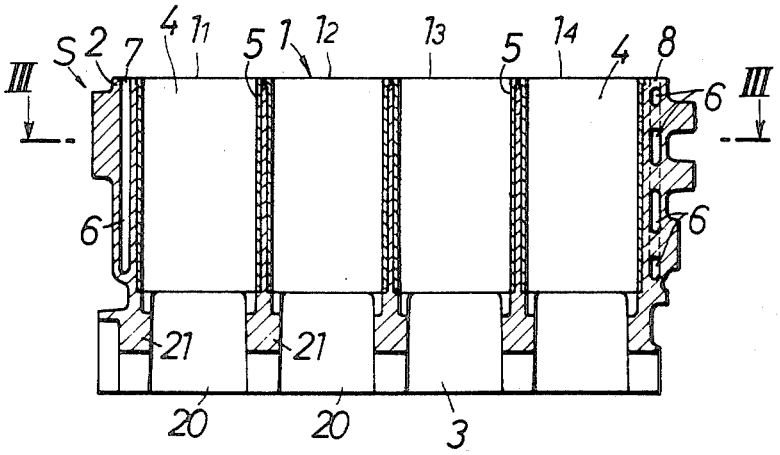
Figure 3:
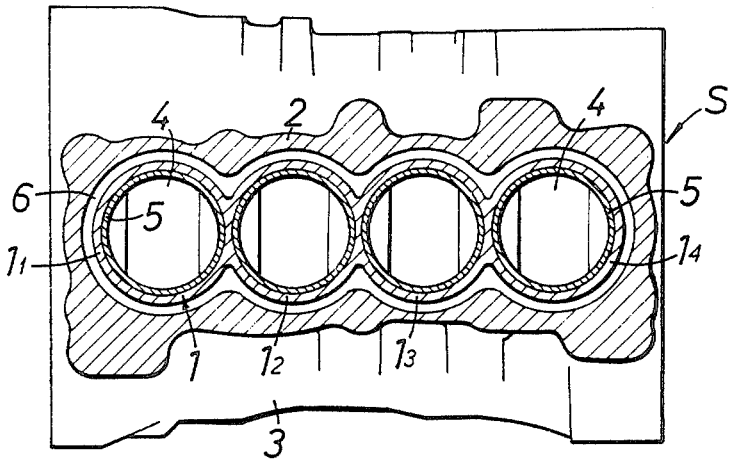

FIGS. 1 to 12 illustrate a first embodiment of the present invention.

FIGS. 1 to 4 illustrate a siamese-type cylinder block S of an aluminum alloy produced from a cylinder block blank of a light alloy according to the present invention. The cylinder block S is comprised of a siamese-type cylinder barrel 1 consisting of a plurality of, e.i., four (in the illustrated embodiment) cylinder barrels $\mathbf{1}_1$ to $\mathbf{1}_4$ interconnected in series, an outer wall 2 surrounding the siamese-type cylinder barrel 1, and a crankcase 3 connected to the lower edge of the outer wall 2. A cast iron cylinder sleeve 5 is embedded in a cylinder bore 4 in each of the cylinder barrels $\mathbf{1}_1$ to $\mathbf{1}_4$, and serves to reinforce the portion around the cylinder bore 4.

Formed between the siamese-type cylinder barrel 1 and the outer wall 2 is a water jacket 6 which faces the entire outer periphery of the siamese-type cylinder barrel 1. At that end of the water jacket 6 which is close to a cylinder head, the siamese-type cylinder barrel 1 is partially connected with the outer wall 2 by a plurality of reinforcing deck portions 8, and the space between the adjacent reinforcing deck portions functions as a communication port 7. Thus, the cylinder block S is constituted into a closed deck type.

Figure 5:
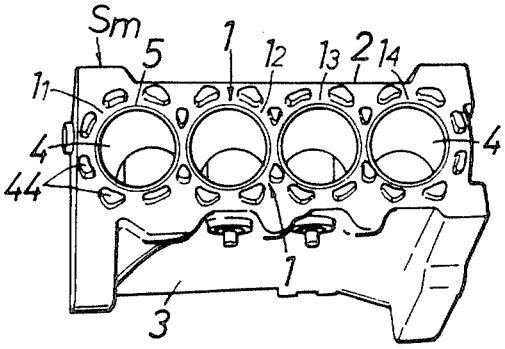
FIG. 5 is a perspective view of one example of a cylinder block as viewed from the above.
Figure 4:
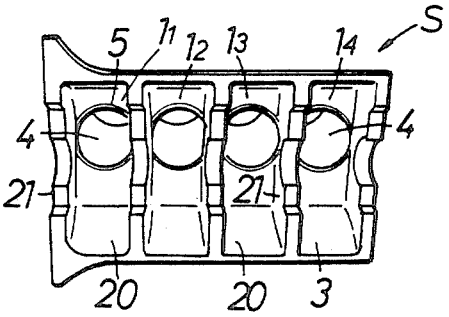

Referring to FIGS. 6 to 9, there is shown a casting apparatus employed in carrying out the present invention to cast a cylinder block blank Sm as shown in FIG. 5. The apparatus comprises a mold M as a casting mold. The mold M is constituted of a liftable upper die 9, first and second laterally (in FIGS. 6 and 7) split side dies $\mathbf{10}_1$ and $\mathbf{10}_2$ disposed below the upper die 9, third and fourth laterally (in FIG. 8) split side dies $\mathbf{10}_3$ and $\mathbf{10}_4$ and a lower die 11 on which the individual side dies $\mathbf{10}_1$ to $\mathbf{10}_4$ are slidably laid.

Figure 8:
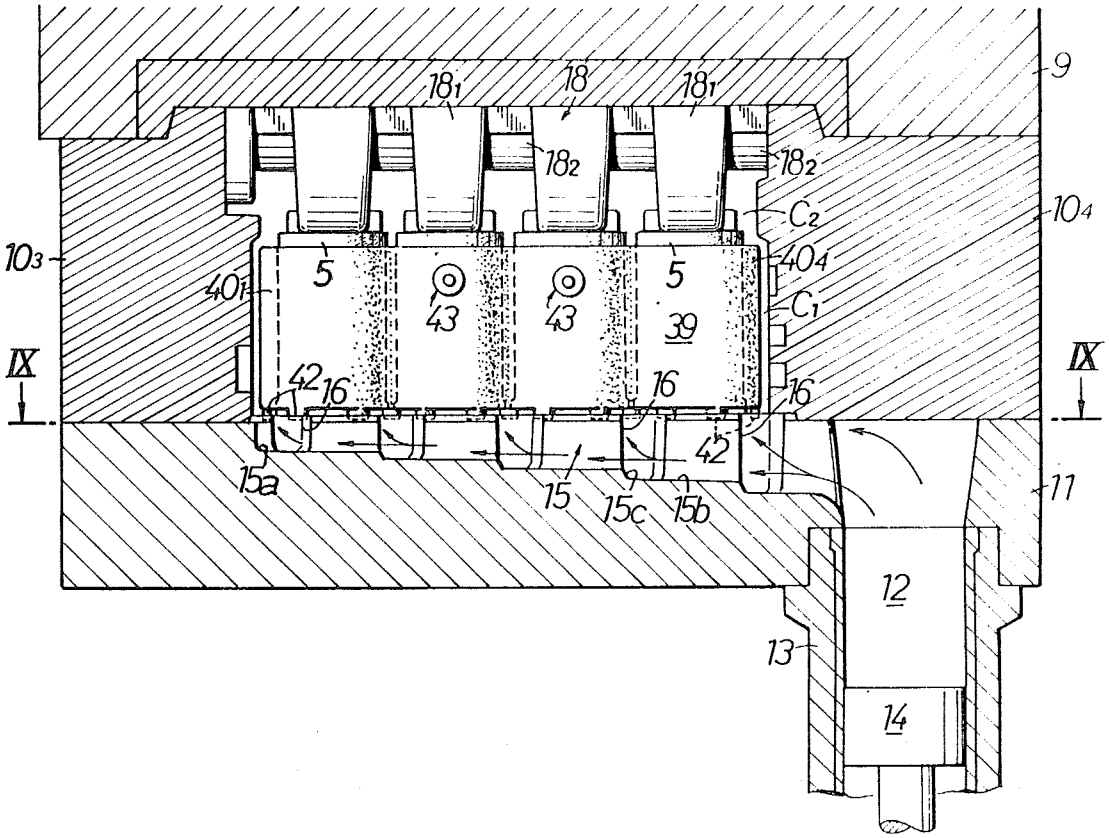
Figure 9:
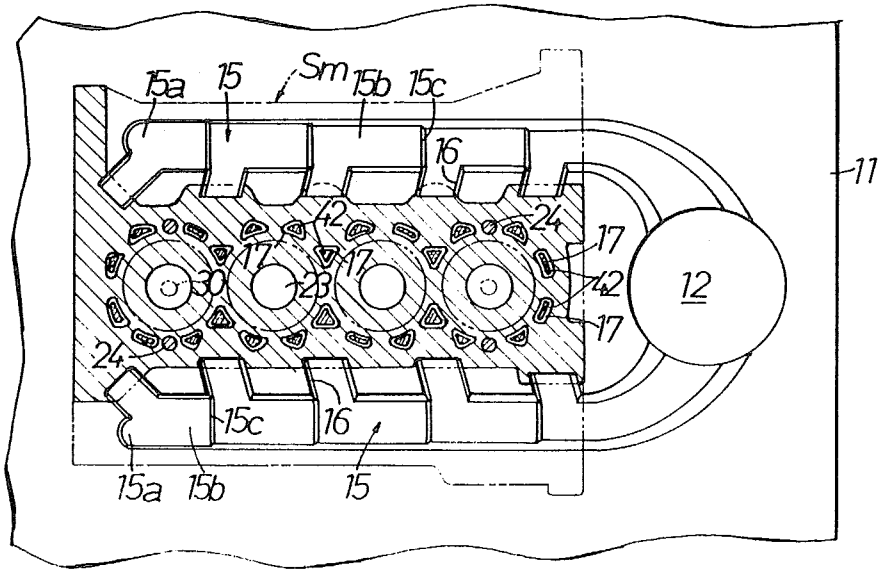

As shown in FIGS. 8 and 9, the lower die 11 is provided with a basin 12 for receiving a molten metal of aluminum alloy from a furnace (not shown) and a pouring cylinder 13 communicating with the basin 12. A plunger 14 is slidably fitted in the pouring cylinder 13, and a pair of runners 15 bifurcate from the basin 12 to extend substantially parallel to each other.

A first cavity $C_1$ for molding the siamese-type cylinder barrel 1 and the outer wall 2 is defined by cooperation between the upper surface of the lower die 11 between the runners 15 lower half of each the side dies $\mathbf{10}_1$ to $\mathbf{10}_4$. The first cavity $C_1$ communicates at its opposite lower sides with both the runners 15 through a plurality of gates 16. A number of recesses 17 used to form a communicating port 7 are made in the outer peripheral portion of the upper surface of the lower die facing the first cavity $C_1$.

The upper die 9 includes a molding block 18 which protrudes downwardly and in cooperation with the upper half of each of the side dies $\mathbf{10}_1$ to $\mathbf{10}_4$ defines a second cavity for molding the crankcase 3. The cavity $C_2$ communicates at its lower end with the upper end of the first cavity $C_1$.

The molding block 18 is comprised of four first taller semicolumner molding portions $\mathbf{18}_1$ formed at predetermined distances, and second protruded molding portions $\mathbf{18}_2$ located between the adjacent first molding portions $\mathbf{18}_1$. Each of the first molding portions $\mathbf{18}_1$ is used to shape a space 10 (see FIGS. 2 and 4) whithin which the crankpin and the crankarm and rotated, and each of the second molding portions $\mathbf{18}_2$ is employed to mold a crank journal bearing holder 21 (see FIGS. 2 and 4).

The bottom surfaces of both runners 15 are stepped in several ascending stairs to stepwise decrease the sectional area of the runners 15 from the basin 12 toward runner extensions 15*a*. Each riser portion 15*c* connected to each step portion 15*b* is anuglarly formed to enable a molten metal to be smoothly guided into each gate 16.

With the sectional area of the runner 15 reduced stepwise in this way, at the portion larger in sectional area, a large amount of a molten metal can be poured through the gate 16 into the first cavity $C_1$ at a slower speed, and at the portion smaller in sectional area, a smaller amount of a molten metal can be poured through the gate 16 into the first cavity $C_1$ at a faster speed. Therefore, the molten metal is poured into the cavity $C_1$ to rise in level substantially equally over the entire length thereof, thus eliminating the occurence of a turbulence of the molten metal within the cavity $C_1$, and preventing gas such as air from being included into the molten metal and thereby avoiding the generation of any gaseous inclusions in the cast blank. Moreover, the molten metal pouring operation is effectively conducted, thus enhancing efficiency of the casting operation.

A core 19 with a vertical axis protrudes from the lower surface of each of the first molding portions $18_1$ and a locating projection 22 is provided on the lower die 11 opposite the lower end of the core 19. The lower end of a cylinder sleeve 5 is fitted on the projection 22 in alignment with and for internally receiving the core 19. A recess 23 is formed at the center of the locating projection 22, for receiving a convex portion 19*a* of the core 19. A through hole 24 is made on each side of the locating projection 22, as viewed in FIGS. 6 and 7, in and through the lower die 11 to provide access so a pair of temporary locating pins 25 may be slidably fitted in the through holes 24 respectively. The pins 25 are used to temporarily locate a water jacket shaping sand core 39 which will be described hereinafter. The lower ends of the pins 25 are fixedly secured to a mounting plate 26 disposed in a space provided to the lower die 11. Two support rods 27 are inserted through the mounting plate 26, and a coil spring 28 is provided in compression between the lower portion of each support rod 27 and the lower surface of the mounting plate 26. As the mold is opened, the mounting plate 26 is subjected to the resilient force of each the coil springs 28 and moves up until it abuts against the stopper 27*a* on the fore end of each of the support rods 27, thereby allowing the fore end of each the temporary locating pins 25 to protrude from the top surface of the lower die 11. A recess 25*a* is made at the fore end surface of each of the temporary locating pins 25 for engagement by the lower edge of the sand core.

A through hole 29, centered between the through holes 24, is made in and through the lower die 11 to slidably accomodate an operating pin 30 fixed at its lower end to the mounting plate 26. When the mold is open, the fore end of the operating or actuating pin 30 protrudes into the recess 23, and as the mold is closed, the fore end of the operating pin 30 is pushed down by the core 19, thereby retracting the mounting plate 26 and both the temporary locating pins 25 from the top surface of the lower die 11. A core bedding recess 31 for positively locating the sand core 39 in the cavity $C_1$ is provided in each wall of the first and second side dies $10_1$ and $10_2$ which define the first cavity $C_1$. Each of the core bedding recesses 31 consists of an engaging bore 31*a* for positioning the sand core, and a clamp surface 31*b* formed around the outer periphery of the opening of the engaging bore 31*a* for clamping the sand core.

A plurality of third cavities $C_3$ are provided in the opposite base portions of each the first molding portions $18_1$ of the molding block 18. The third cavities $C_3$ communicate with the second cavity $C_2$ to permit the overflow of a molten metal from second Cavity $C_2$. A gas vent passage 32 communicating with each of the third cavities $C_3$ is also made in the upper die 9. The gas vent passage 32 comprises a small diameter portion 32*a* communicating with the third cavity $C_3$ and a larger diameter portion 32*b* connected to the smaller diameter portion 32*a*.

A closing pin 34 is loosely inserted into the larger diameter portion 32*b*. The upper end of the closing pin 34 is fixed to a mounting plate 36 disposed above the upper die 9. A hydraulic cylinder 37 is also interposed between the upper die 9 and the mounting plate 36 and is operable to move the mounting plate 36 upwardly or downwardly, thereby causing the closing pin 34 to engage with or disengage from the smaller diameter portion 32*a*, thereby opening and closing the gas vent passage 32. The reference numeral 38 designates a rod for guiding the mounting plate 36.

Figure 10:
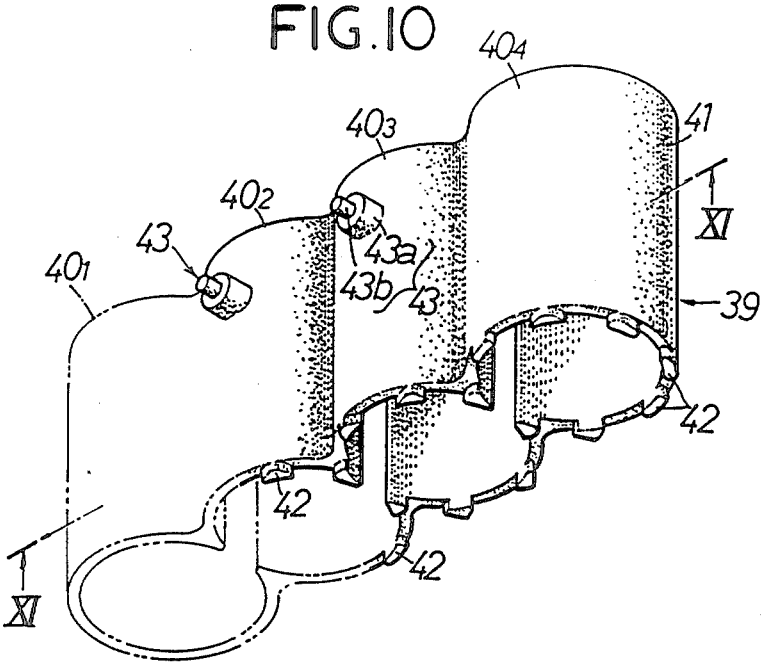
FIGS. 10 and 11 illustrate a sand core for a water jacket, FIG. 10 being a perspective view as viewed from below, and FIG. 11 being a sectional view taken along the line XI—XI in FIG. 10.
Figure 11:
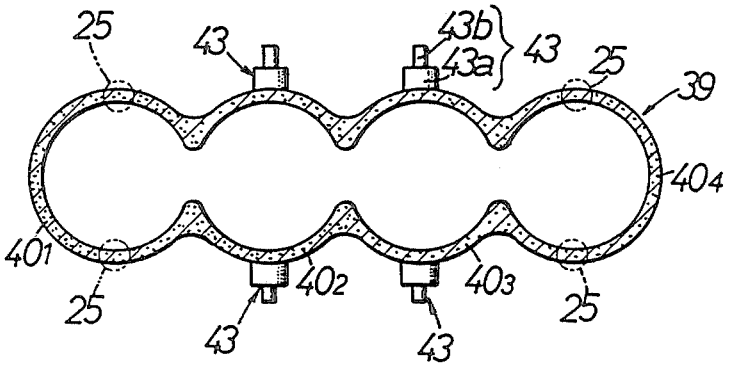

FIGS. 10 and 11 illustrate the water jacket shaping sand core 39 which is constituted of a core body 41 including four cylindrical portions $40_1$ to $40_4$ corresponding to the four cylinder barrels $1_1$ to $1_4$ of the cylinder block S, with the peripheral interconnecting walls of the adjacent cylindrical portions being eliminated. A plurality of projections 42 are provided on the lower end surface of the core body 41 to form the communication ports 7 permitting fluid communication between the water jacket 6 with a water jacket in a cylinder head and the reinforcing deck portions 8. Core prints 43 are respectively provided on the opposite outer side surfaces of the two cylindrical portions $40_2$ and $40_3$ located at the middle. Each of the core prints 43 is comprised of a larger diameter portion 43*a* integral with and protruding from the core body 41 and a smaller diameter raised portion 43*b* protruding from the end surface of the larger diameter portion 43*a*.

Description will now be made of the operation of casting a cylinder block blank Sm in the above-described casting apparatus.

Figure 6:
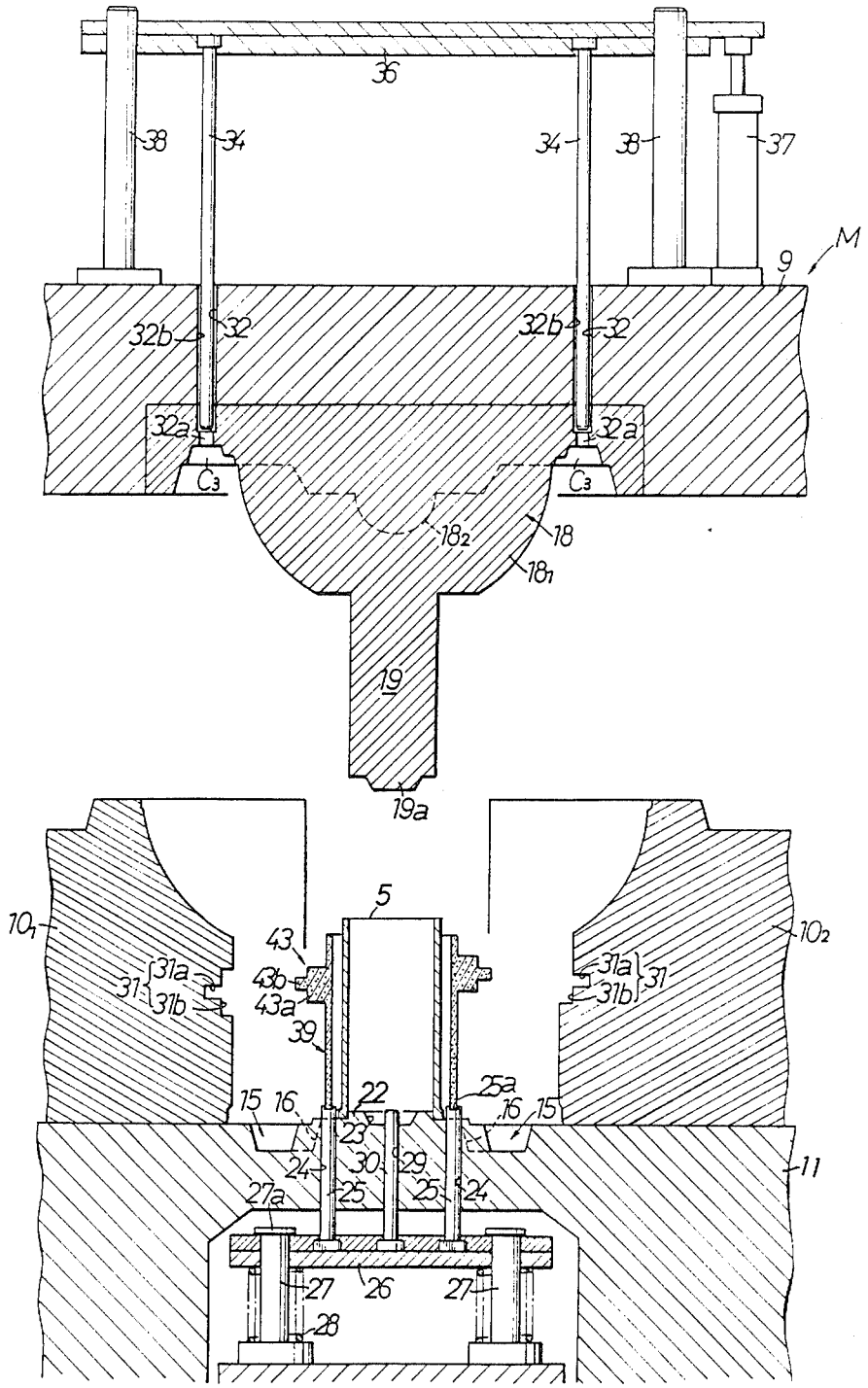
FIGS. 6 to 9 illustrate one example of casting by a casting apparatus.

First, as shown in FIG. 6, the upper die 9 is moved up and the opposed side dies $10_1$ and $10_2$, and $10_3$ and $10_4$, are moved away from each other to open the mold. The hydraulic cylinder 37 on the upper die 9 is operated to lift the individual closing pins 34 through the mounting plate 36, whereby the lower ends of the closing pins 34 are pulled out of the smaller diameter portions 32*a* to open the gas vent passages 32. Further, the plunger 14 within the pouring cylinder 12 is moved down.

The lower end of the cylinder sleeves 5 are fitted to each of the locating projections 22 of the lower die 11 to erect the cylinder sleeves 5 on the lower die 11. As shown in FIGS. 6 and 8, each of the cylindrical portions $40_1$–$40_4$ of the sand core 39 is loosely fitted around one of the cylinder sleeves 5, and the lower ends of the opposite cylindrical portions $40_1$ and $40_4$ are brought into engagement with the recesses 25*a* of the temporary locating pins 25 of the lower die 11, thereby temporarily locating the sand core 39. Each of the projections 42 of the sand core 39 is loosely inserted into each of the recesses 17 of the lower die 11, as shown in FIGS. 7 and 9.

Figure 7:
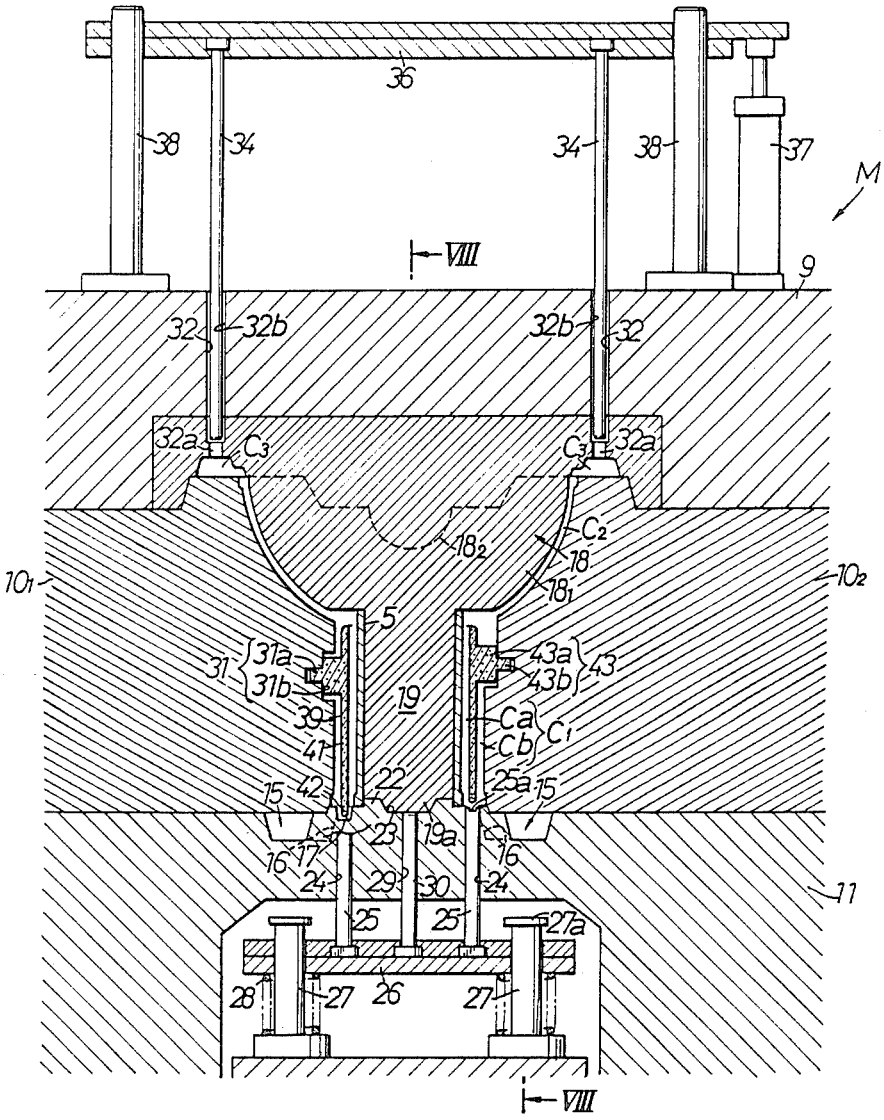

As shown in FIG. 7, the side dies $10_1$ and $10_2$ are moved a predetermined distance toward each other to bring each core bedding recess 31 into engagement with each core print 43, thus positively locating the sand core 39 in the cavity $C_1$. More specifically, the smaller diameter portion **43*b* of each core print 43 is fitted into the engaging bore 31*a* in each core bedding recess 31 to position the sand core 39, while the end surface of each larger diameter portion 43*a* parallel to the direction of the cylinder barrels is mated with each clamp surface 31*b* to clamp the sand core 39 by clamp surfaces 31*b***. The side dies and $10_3$ and $10_4$ are also moved in the similar manner.

Then, the upper die 9 is moved down to complete closure or clamping of the mold. With this clamping, each core 19 is inserted into each cylinder sleeve 5. The fitting between the raised portion **19*a* of the core 19 and the recess 23 of the lower die 11 causes the operating or actuating pin 30 to be forced down, whereby each temporary locating pin 25 is moved down and retracted from the top surface of the lower die 11. The first cavity $C_1$ is sectioned into a cylinder barrel molding portion Ca between the core 19 and the sand core 39, and an outer wall molding portion Cb between the sand core 39** and each of the side dies $10_1$ to $10_4$.

A molten metal of aluminum alloy (JIS ADC12) at 730° to 740° C. is supplied from a furnace into the basin 12 of the lower die 11 and then, the plunger 14 is moved up at a predetermined velocity to pass the molten metal through the runners 15 and pour it through the gates 16 into the cavity $C_1$ and the second cavity $C_2$ from the opposite lower portions of the first cavity $C_1$ under a pressure $p_1$ (FIG. 12) over the atmospheric pressure. Gas such as air within the cavities $C_1$ and $C_2$ is forced up by the molten metal and vented upwardly from the upper die 9 via the gas vent passage 32 communicating with the third cavity $C_3$.

In this case, the upward movement of the plunger 16 causes the molten metal to be passed through the both runners 15 and poured via the gates 16 into the first cavity $C_1$ substantially equally over the entire length between the opposite lower ends thereof, because the bottom surfaces of the both runners 15 are stepped in several upward stairs from the basin 12 so that the sectional area of the runners 15 may be reduced toward the runner extensions **15*a***.

After the third cavity $C_3$ has been fully filled with the molten metal, the hydraulic cylinder 37 on the upper die 9 is operated to move the mounting plate 36 down thereby fitting the lower ends of the closing pins 34 into the smaller diameter portions **32*a* to close the gas vent passages 32, respectively. Then, the plunger 14 is raised at a predetermined velocity to retain the molten metal under a high pressure $p_2$ (FIG. 12**) exceeding the above-mentioned pressure $p_1$ and completely solidify the molten metal thereby densifying the structure of the aluminum alloy and improving its strength.

In this case, since the molten metal is poured into the first cavity $C_1$ from the lower portion thereof and the sand core 39 has its heat retaining action, the temperature of the molten metal around the cylinder sleeves in the first cavity $C_1$ is prevented from being lowered and hence the adhesion between the aluminum alloy and the cylinder sleeve 5 is enhanced. Furthermore, deformation of the cylinder sleeves 5 resulting from the pressure of the molten metal is prevented by the core 19.

Because the sand core 39 is clamped in an accurate position by both side dies $10_1$ and $10_2$ through the individual core prints 43 of the sand core, it cannot float up during pouring of the molten metal into the first cavity $C_1$ or during pressing of the molten metal within the cavity $C_1$. In addition, since the end surface of the larger diameter portion **43*a* of each core print 43 mates with the clamp surface 31*b* of the core bedding recess 31 in each of the side dies $10_1$ and $10_2$, the deforming force of the molten metal on the sand core in cavity $C_1$ is suppressed by each clamp surface 31*b*, thus providing a siamese-type cylinder barrel 1 having a uniform thickness around each cylinder bore 4**.

After the solidification of the molten metal has been completed, the mold is opened to give a cylinder block blank Sm as shown in FIG. 5.

The cylinder block blank Sm is then subjected to grinding to remove the projected portions 44 each of which is formed by a recess 17. Consequently, the communication ports 7 and the reinforcing deck portions 8 are formed. In addition, the extraction of the sand provides the water jacket 6. Further, the inner peripheral surface of each cylinder bore 4 is subjected to a working into a true circle and a further intended working is conducted, thereby giving a cylinder block S as shown in FIGS. 1 to 4.

FIGS. 13 to 22 illustrate a second embodiment of the present invention.

A siamese-type cylinder block S' of aluminum alloy is shown in FIGS. 13 to 16 and has substantially the same structure as that of the first embodiment, and therefore, parts of the second embodiment which are identical to corresponding parts of the first embodiment are identified by the same reference numerals as previously used to avoid a repetitious description of the same parts.

Figure 17:
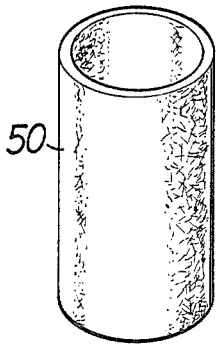
FIG. 17 is a perspective view of a shaped fiber article.

The second embodiment is different from the first embodiment in that a portion of the cylinder barrel around the cylinder bore 4 is reinforced by a cylindrical shaped fiber article 50 as a reinforcing tubular body (FIG. 17). The shaped fiber article 50 together with an aluminum alloy matrix constitute a fiber reinforced composite tubular body 51.

The shaped fiber article 50 is formed from a mixture of short fibers comprising carbon fibers and alumina fibers. The outer diameter of the article 50 is 89 mm, its inner diameter is 78 mm, its height is 152 mm, and its bulk density is 0.3 g/cm$^3$. The shaped fiber article 50 is obtained by mixing, in a ratio of 1 to 3, a carbon fiber (a short fiber) having an average diameter of 18 mm and an average length of 0.8 mm, and an alumina fiber (a short fiber) having an average diameter of 3 to 4 mm and an average length of 0.5 mm, a silica sol. being added as an inorganic binder to the mixed short fiber, and a suction-adhesion molding process being applied thereto. In this case, an alumina sol. alone or a mixture of silica sol. and an alumina sol. may be used in place of the silica sol.

The aforementioned suction-adhesion process is a process in which a cylindrical die with its opposite end sealed and being an air-permeably is stood upright within a vessel into which a mixture of said mixed short fiber and are silica sol. provided. A suction action is applied to the interior of the cylindrical die to attract said mixture against the outer peripheral surface of the cylindrical die.

The shaped fiber article 50 thus formed by the above-described process is used after being subjected to drying and calcilation after releasing the article from the die.

Figure 18:
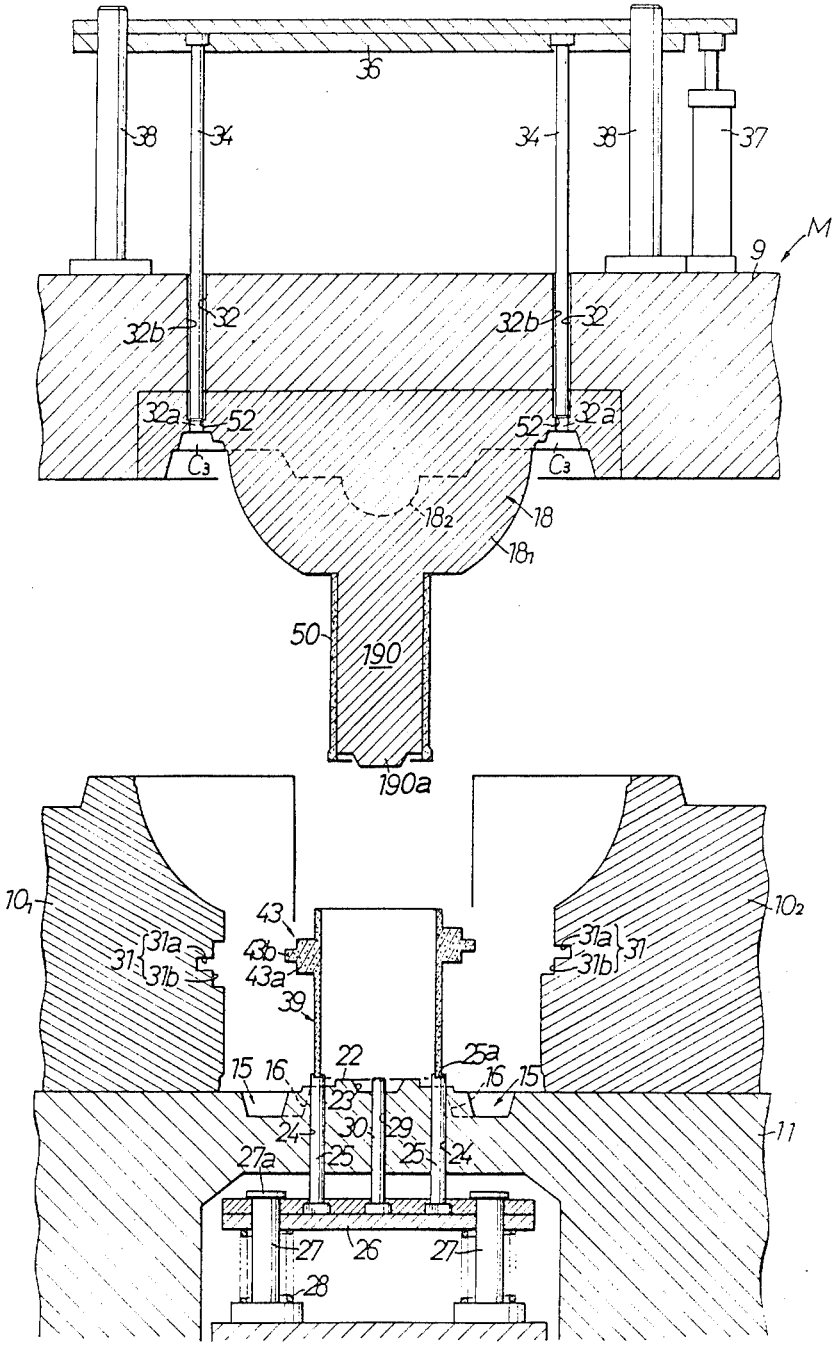
FIGS. 18 to 21 illustrate another example of casting by casting apparatus, FIG. 18 being a front view in vertical section of the apparatus when a mold is opened, FIG. 19 being a front view in vertical section when the mold is closed, FIG. 20 being a sectional view taken along the line XX—XX in FIG. 19, and FIG. 21 being a sectional view taken along the line XXI—XXI in FIG. 20.
Figure 21:
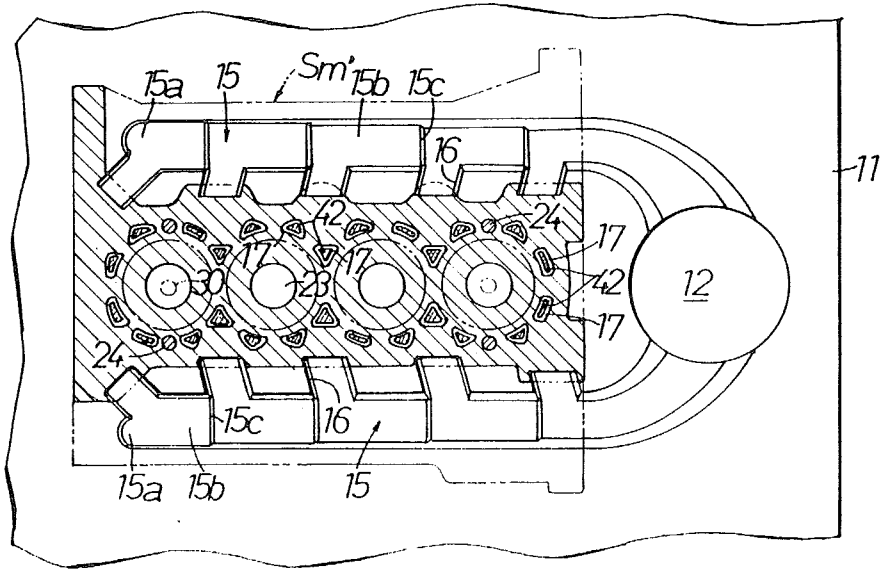
Figure 22:
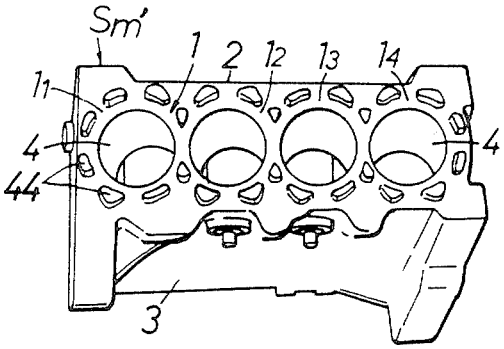
FIG. 22 is a perspective view of another example of a cylinder block blank as viewed from above.
Figure 16:
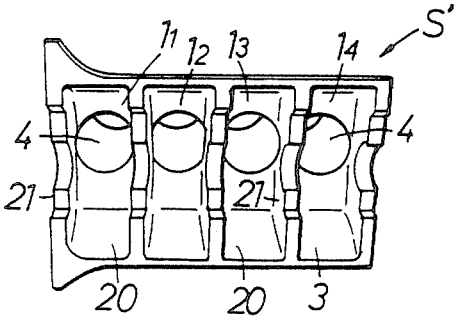

FIGS. 18 and 21 illustrate a casting apparatus, which is used in practicing this embodiment of the present invention to cast a cylinder block blank Sm' as shown in FIG. 22. Except for certain elements unique to this embodiment the casting apparatus has the totally same structure as that used and described in the first embodiment and the parts which are identical to corresponding parts of the first embodiment are indicated by the same reference numerals to avoid a repetitious description of the structure thereof. In this apparatus, however, the core 19 of the first embodiment (FIG. 19) functions as a cylinder bore shaping core 190.

The operation for casting the cylinder block blank Sm' by the casting apparatus of FIGS. 18 to 21 using the above-described shaped fiber article 50 will now be described.

First, as shown in FIG. 18, the upper die is moved up, and the opposed side dies $10_1$ and $10_2$, and $10_3$ and $10_4$, are moved away from each other to open the mold. The hydraulic cylinder 37 on the upper die 9 is operated to lift the individual closing pins 34 by means of the mounting plate 36, whereby the lower ends of the closing pins 34 are positioned adjacent the upper openings of the smaller diameter portions 32*a* of the vent passages 34 to throttle the vent passages by forming the very small openings 52.

Further,the plunger 14 within the pouring cylinder 12 is move down.

Each shaped fiber article 50 preheated to approximately 300° C. is mounted to each core 190 so that the opening at the upper end of the shaped fiber article 50 is brought into abutment with the lower surfaces of the first molding portion $18_1$.

The lower ends of the opposite cylindrical portions $40_1$ and $40_4$ of a same sand core 39 identical to that used in the previously described first embodiment are brought into engagement with the recesses 25*a* of the temporary locating pins 25 of the lower die 11, thereby temporarily locating the sand core 39. Each of the projections 42 of the sand core 39 is loosely inserted into each of the recesses 17 of the lower die 11, as shown in FIGS. 19 to 21.

Figure 19:
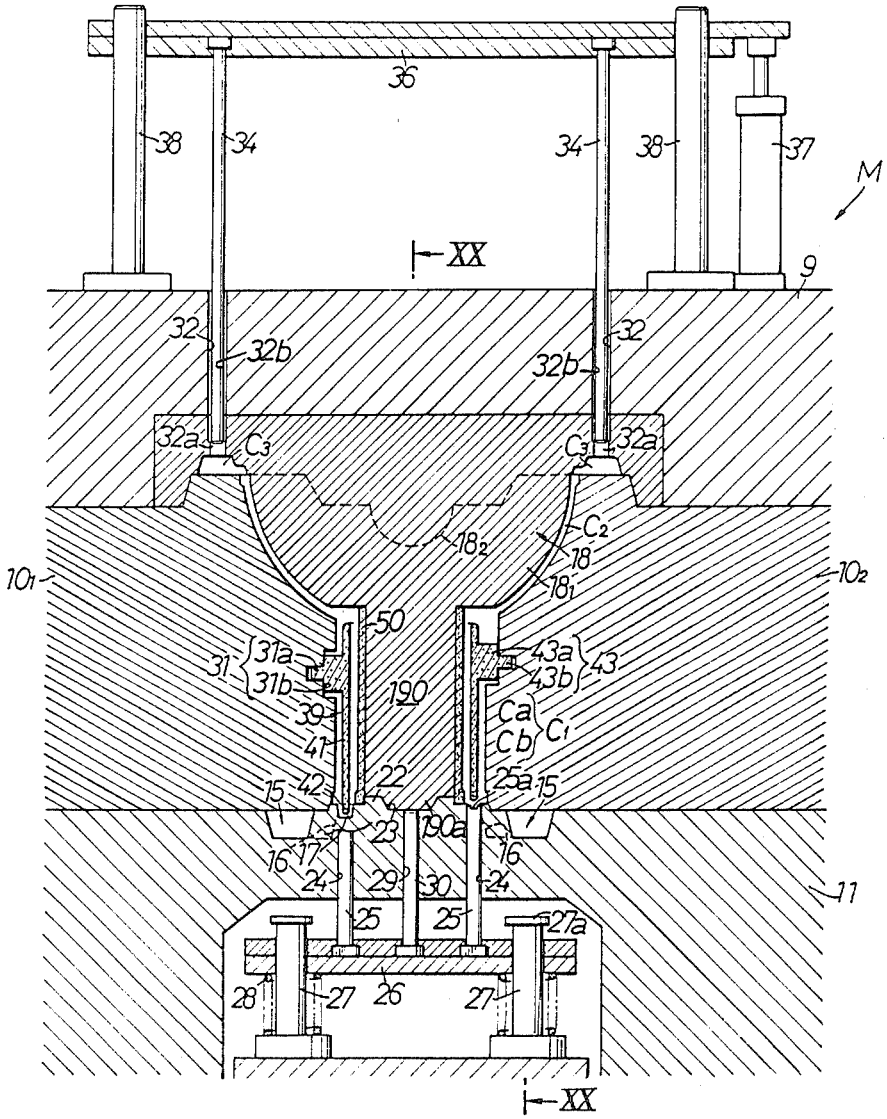
Figure 20:
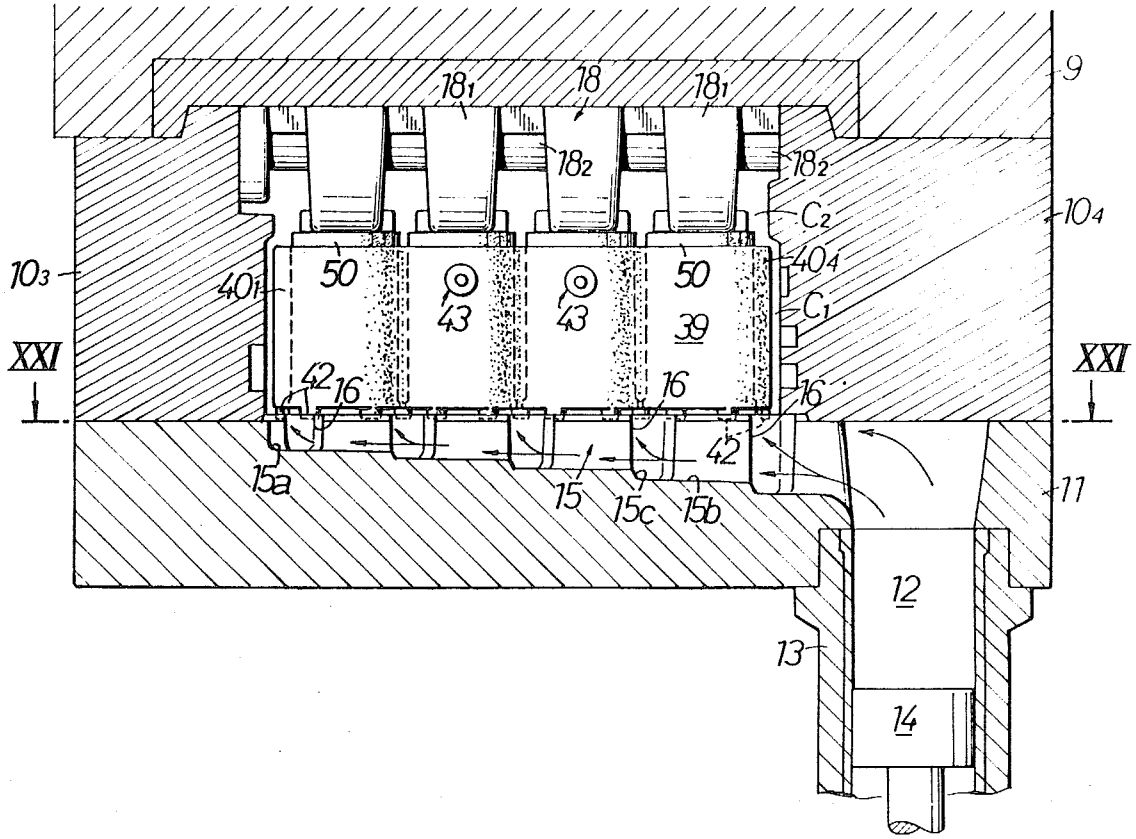

As shown in FIG. 19, the side dies $10_1$ and $10_2$ are moved a predetermined distance toward each other to bring each core bedding recess 31 into engagement with each core print 43, thus effecting the final placing or location of the sand core 39 in the cavity $C_1$ in a manner similar to that of the first embodiment. Further, the side dies $10_3$ and $10_4$ are also likewise moved.

Then, the upper die 9 is moved down to complete clamping of the die assembly. With this clamping, each of the shaped fiber articles 50 is inserted into one of the cylindrical portions $40_1$ to $40_4$ of the sand core 39, and the lower end of each of the shaped fiber articles 50 is fitted into the locating projection 22. The raised portion 190*a* of the core 190 fitting into the recess 23 of the lower die 11 forces the operating or actuating pin 30 down and each temporary locating pin 25 is moved down and retracted from the top surface of the lower die 11. The first cavity $C_1$ is sectioned into a cylinder barrel molding portion Ca and an outer wall molding portion Cb.

A molten metal of aluminum alloy (JIS ADC12) at 730° to 740° C. is supplied from a furnace into the basin 12 of the lower die 11 and then, the plunger 14 is moved up at a velocity from 0.08 to 0.3 m/sec. to pass the molten metal through the runners 15 and pour it through the gates 16 into the cavity $C_1$ and the second cavity $C_2$ from the opposite lower portions of the first cavity $C_1$. A gas such as air within both the cavities $C_1$ and $C_2$ is forced up by the molten metal and vented upwardly from the upper die 9 via the gas vent passages 32 communicating with the third cavity $C_3$.

In this case also, in a manner similar to that of the above-described first embodiment, the upward movement of the plunger 14 causes the molten metal to be passed through the both runners 15 and poured via the gates 16 into the first cavity $C_1$substantially equally over the entire length thereof from the opposite lower ends thereof.

Figure 12:
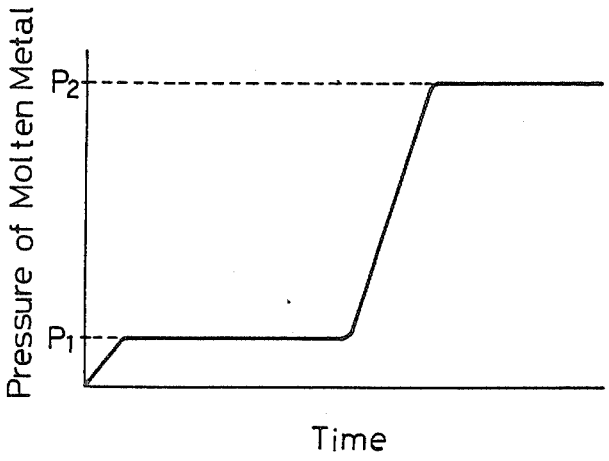
FIG. 12 is a graph illustrating a relationship between the pressure of a molten metal and the time.
Figure 13:
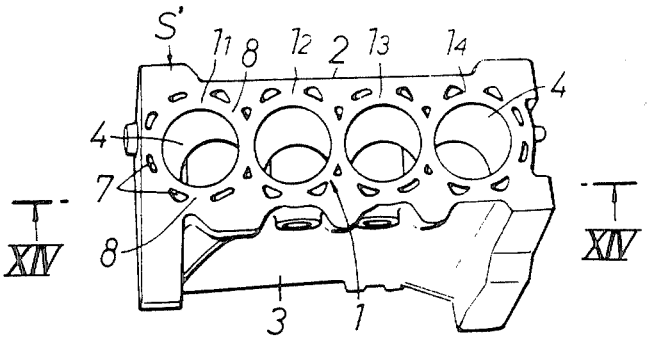
FIGS. 13 to 16 illustrate another example of a siamese-type cylinder block, FIG. 13 being a perspective view as viewed from above, FIG. 14 being a sectional view taken along the line XIV—XIV in FIG. 13, FIG. 15 being a sectional view taken along the line XV—XV in FIG. 14, and FIG. 16 being a perspective view as viewed from below.
Figure 14:
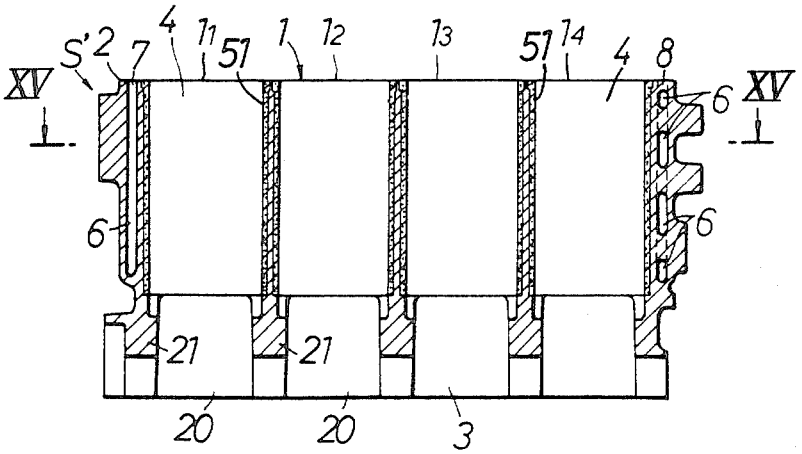
Figure 15:
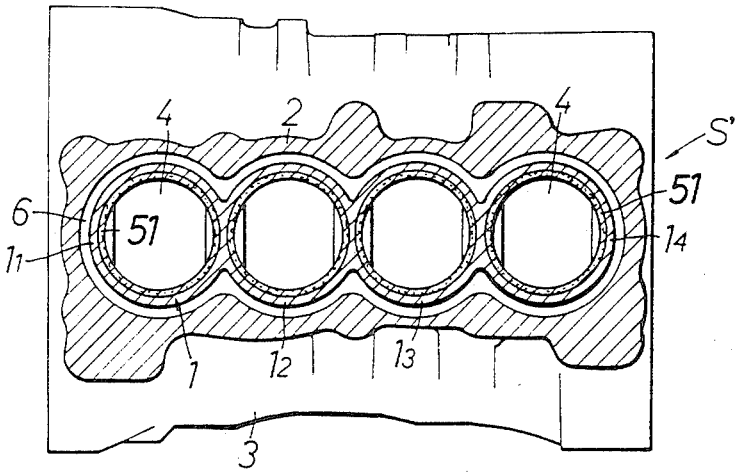

In addition, a back pressure is developed within the first and second cavities $C_1$ and $C_2$ by the throttling effect of the very small openings 52 in the respective gas vent passages 32 and equally acts on the entire molten metal surface. Consequently, the molten metal surface raises substantially horizontally while being suppressed against the formation of waves or other turbulence. The gas is thus prevented from being included into the molten metal and also the gas is efficiently vented to avoid the formation of any mold cavities. Due to the above-mentioned back pressure, the pressure of molten metal poured in the first and second cavities $C_1$ and $C_2$ becomes a level $p_1$ exceeding an atmospheric pressure, e.g., 2 to 5 kg/cm$^2$, as shown in FIG. 12.

Further, pre-heating the shaped fiber article 50 to the above-described temperature, virtually assures the temperature of the molten metal will be maintained in the cavity $C_1$ and avoids solidification and deposition of the molten metal on the fiber shaped article 50.

After the third cavity $C_3$ has been completely filled with the molten metal, the hydraulic cylinder 37 on the upper die 9 is operated to move the mounting plate 36 down and the closing pins 34 into the smaller diameter vent passage portions 32*a* communicating with the third cavity $C_3$ to close the gas vent passages 32, respectively.

Then, the plunger 14 is raised at a velocity of 0.14 to 0.18 m/sec to retain the molten metal under a high pressure $p_2$ exceeding the above-mentioned pressure $p_1$, i.e., under a pressure of 400 kg/cm$^2$ and completely solidify the aluminum alloy thereby densifying the structure of the aluminum alloy and improving its strength.

In the course of increasing the pressure on the molten metal, the penetration or filling of the molten metal into the shaped fiber article 50 is insured at a pressure of 5 to 20 kg/cm$^2$ on the molten metal. In this apparatus, the first cavity $C_1$ is positioned at a lower location in the vicinity of the runners 15, and the temperature of the molten metal is maintained by the sand core 39 and the preheated shaped fiber article 50 and therefore the temperature of the molten metal is maintained at a high level, whereby the molten metal is smoothly filled into the shaped fiber article 50. In this embodiment, with maintenance of the high temperature of the molten metal, the pressure applied to the molten metal can be lower and hence, the shaped fiber article 50 is not as likely to be broken by the molten metal during the filling thereof.

In this embodiment, floating and deformation of the sand core 39 during pouring and pressurization of the molten metal may be prevented in the same manner as in the first embodiment.

After the solidification of the molten metal has been complete, the mold is opened to give a cylinder block blank Sm' as shown in FIG. 22.

Thereafter, the cylinder block blank Sm' is subjected to similar processes to those done in the previously described first embodiment to give a cylinder block S' shown in FIGS. 13 to 16.

It should also be noted that the shaped fiber article 50 may be molded from only one kind of reinforcing fiber. In addition, the shaped fiber article 50 may at times be used at ambient temperature.

In addition to the aforesaid aluminum alloy, the light alloy used in the present invention may also be a magnesium alloy or the like.

Figure 23:
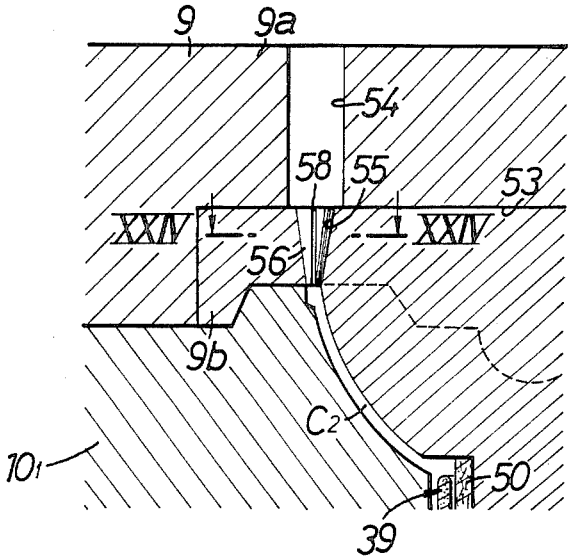
FIGS. 23 and 24 illustrate a further example of the casting apparatus, FIG. 23 being a front view in vertical section of the details when a mold is closed, and FIG. 24 being an enlarged view of a portion of the apparatus taken along the line XXIV—XXIV in FIG. 23.
Figure 24:
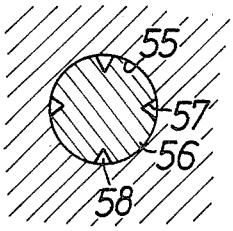

FIGS. 23 and 24 illustrate a modification of a gas vent passage. In this modification, the upper die 9 is comprised of a body 9*a* and a cavity-defining member 9*b* fitted in a downwardly turned recess 53 in the body 9*a*. A plurality of gas discharging holes 54 are made in the body 9*a*, and plurality of mounting holes 55 communicating with the second cavity $C_2$ and the gas discharging holes 54 are made in the cavity-defining member 9*b*. Each of the mounting holes 55 is tapered from its upper end toward its lower end. A tapered pin 56 is fitted in each mounting hole 55. A gas vent passage 58 in the form of a very small hole is defined by the inner surface of each of a plurality of V-shaped grooves 57 made in and extending along the length of the outer, tapered, peripheral surface of the pin 56 and by the inner peripheral surface of each mounting hole 55. In this case, the depth of each groove 57 is set at 0.1 to 0.5 mm.

The closing of the gas vent passage 58 is effected by solidification of the molten metal which has entered each gas vent passage 58. In this case, the molten metal is immediately cooled and solidified by the upper die 9 when it has entered the gas vent passage 58 by only a short distance. The solidified metal is released from the mold along with the cylinder block blank Sm' when the latter is released from the mold.

Figure 25:
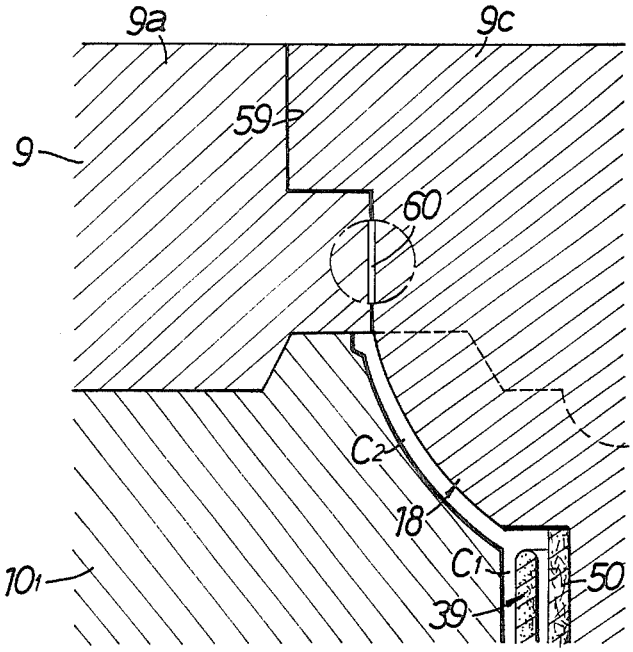
FIG. 25 is a front view in vertical section of still another example of the casting apparatus showing details of the apparatus when the mold is closed.

FIG. 25 illustrates another modification of a gas vent passage. In this case, the upper die 9 is comprised of a body 9*a* and a molding block structure member 9*c* fitted into a stepped through hole 59. A gas vent passage 60 is defined between the stepped through hole 59 and the molding block structure member 9*c* and thus, is provided by a very small clearance of 0.1 to 0.5 mm between the spaced surfaces.

The closing of the gas vent passage 60 is effected by solidification of the molten metal which has entered the passage 60. The solidified metal is released from the mold along with the cylinder block blank Sm' when the latter is released from the mold.

What is claimed is:

1. A process for casting a oylinder block blank made of a light alloy and including a cylinder barrel reinforced around its cylinder bore with a reinforcing tubular body and a crankcase integral with said cylinder barrel, comprising the steps of: providing a multiple component mold having first and second cavities with said first cavity in a lower portion of said mold and defining the exterior form of a cylinder barrel and said second cavity in an upper portion of said mold and defining the form of said crankcase, said second cavity communicating with said first cavity; providing molten metal delivery means at the lower end of said first cavity and gas vent passage means at the upper end of said second cavity; said components of said multiple component mold being movable relative to each other to open or close said mold which is normally open when not in use, placing a reinforcing tubular body in said first cavity defining the exterior form of said cylinder barrel, closing said die and pouring a light alloy molten metal from said delivery means at the lower portion of said first cavity into said first cavity and then into the second cavity.

2. A process for casting a cylinder block blank made of light alloy according to claim 1, wherein said light alloy is an aluminum alloy.

3. A process for casting a cylinder block blank made of ligth alloy according to claim 1, wherein said reinforcing tubular body is formed of cast iron.

4. A process for casting a cylinder block blank made of light alloy according to claim 1, wherein said reinforcing tubular body is a cylindrical shaped fiber article molded with short metallic reinforcing fibers.

5. A process for casting a cylinder block blank made of light alloy according to claim 4, wherein said shaped fiber article is disposed in said first cavity at ambient temperature.

6. A process for casting a cylinder block blank made of light alloy according to claim 4, wherein said shaped fiber article is disposed in said first cavity after said article has been preheated.

7. A process for casting a cylinder block blank made of light alloy according to claim 6, wherein the preheating temperature of said shaped fiber article is approximately 300° C.

8. A process for casting a cylinder block blank made of light alloy according to claim 4, wherein said shaped fiber article is obtained by molding a mixture of short fibers including carbon fibers and alumina fibers in an inorganic binder.

9. A process for casting a cylinder block blank made of a light alloy and including a cylinder barrel with a cast iron cylinder sleeve as a reinforcing tubular body, a water jacket located between said cylinder barrel and an outer wall portion and a crankcase integral with said cylinder barrel comprising the steps of: providing a multiple component mold having first and second cavities with said first cavity in a lower portion of said mold and defining said outer wall portion of said cylinder barrel and said second cavity in an upper portion of said mold and defining the form of said crankcase, said second cavity communicating with said first cavity; providing molten metal delivery means at the lower end of said first cavity and gas vent passage means at the upper end of said second cavity; said components of said multiple component mold being movable relative to each other to open or close said mold which is normally open when not in use, placing a cast iron cylinder sleeve and a sand core in said first cavity with said sand core surrounding said cast iron cylinder sleeve, closing said mold, and pouring a light alloy molten metal from said delivery means at the lower portion of said cavity into said first cavity and then into said second cavity.

10. A process for casting a cylinder block blank made of light alloy according to claim 9, wherein said light alloy is an aluminum alloy.

* * * * *